US010252278B2

(12) United States Patent
Henne et al.

(10) Patent No.: US 10,252,278 B2
(45) Date of Patent: Apr. 9, 2019

(54) CENTRIFUGE CONTAINER WITH REDUCED FLOW RESISTANCE AND SET COMPRISING A CENTRIFUGE CONTAINER AND A CENTRIFUGE ROTOR

(71) Applicant: Thermo Electron LED GmbH, Langenselbold (DE)

(72) Inventors: Sebastian Henne, Goettingen (DE); Sven Stephan, Bischofferode (DE)

(73) Assignee: Thermo Electron LED GmbH, Langenselbold (DE)

( * ) Notice: Subject to any disclaimer, the term of this patent is extended or adjusted under 35 U.S.C. 154(b) by 148 days.

(21) Appl. No.: 15/132,556

(22) Filed: Apr. 19, 2016

(65) Prior Publication Data

US 2016/0310967 A1 Oct. 27, 2016

(30) Foreign Application Priority Data

Apr. 23, 2015 (DE) ..... 20 2015 006 013 U
Sep. 10, 2015 (DE) ..... 10 2015 011 876

(51) Int. Cl.
*B01L 3/00* (2006.01)
*B04B 5/04* (2006.01)

(52) U.S. Cl.
CPC ..... *B04B 5/0421* (2013.01); *B01L 3/5021* (2013.01); *B04B 5/0414* (2013.01); *B01L 2200/025* (2013.01); *B01L 2300/0858* (2013.01)

(58) Field of Classification Search
CPC ..... B04B 5/0414; B04B 5/0421; B01L 2300/0858; B01L 3/5021; B01L 2200/025
(Continued)

(56) References Cited

U.S. PATENT DOCUMENTS 4,154,690 A * 5/1979 Ballies ..... B01L 3/50215 210/516
4,375,272 A 3/1983 Sutton, III
(Continued)

FOREIGN PATENT DOCUMENTS

DE 69710861 T2 11/2002
DE 102004062231 A1 7/2006
(Continued)

OTHER PUBLICATIONS

United Kingdom Intellectual Property Office, Patents Act 1977: Combined Search and Examination Report under Sections 17 and 18(3), Application No. GB1606787.8, dated Nov. 17, 2016 (5 pages).

(Continued)

*Primary Examiner* — Walter D. Griffin
*Assistant Examiner* — Shuyi S. Liu
(74) *Attorney, Agent, or Firm* — Wood Herron & Evans LLP

(57) ABSTRACT

The present invention relates to a centrifuge container for a centrifuge rotor, with a base body comprising an opening, a vessel bottom and a longitudinal axis, the opening and the vessel bottom being situated opposite each other and the base body extending with its overall length between the opening and the vessel bottom, and the centrifuge container comprising, along the overall length of the base body, a first section extending from the opening and a second section extending to the vessel bottom, the centrifuge container comprising structure non-detachably connected to the container for reducing the flow resistance, the structure being provided exclusively in the region of the second section.

15 Claims, 3 Drawing Sheets

(58) Field of Classification Search
USPC ..... 494/16, 20, 43
See application file for complete search history.

(56) References Cited

U.S. PATENT DOCUMENTS

| | | | | | |
|---|---|---|---|---|---|
| 4,586,918 | A | | 5/1986 | Cole | |
| 4,801,290 | A | | 1/1989 | Gunter | |
| 4,820,257 | A | * | 4/1989 | Ishimaru | B04B 5/0414 494/16 |
| 4,941,867 | A | | 7/1990 | Tominaga | |
| 5,362,300 | A | | 11/1994 | Christensen | |
| 5,728,038 | A | * | 3/1998 | Coffey | B04B 5/0414 494/16 |
| 5,851,170 | A | * | 12/1998 | Howell | B04B 5/0421 494/20 |
| 6,746,391 | B2 | * | 6/2004 | Lurz | B04B 5/0421 494/20 |
| 7,150,708 | B2 | * | 12/2006 | Lurz | B04B 5/0421 494/20 |
| 2006/0183620 | A1 | | 8/2006 | Eigemeier et al. | |
| 2010/0055698 | A1 | * | 3/2010 | Stibelli | B01L 3/502 435/6.13 |
| 2014/0179505 | A1 | * | 6/2014 | David | B04B 5/0421 494/20 |
| 2016/0310966 | A1 | | 10/2016 | Henne et al. | |

FOREIGN PATENT DOCUMENTS

| | | | | |
|---|---|---|---|---|
| DE | 102011050836 | A1 | 12/2012 | |
| GB | 2539757 | A | 12/2016 | |
| JP | 1-151850 | U | 10/1989 | |
| JP | 07047302 | A | 2/1995 | |
| WO | 9740942 | A1 | 11/1997 | |
| WO | 2008064783 | A1 | 6/2008 | |
| WO | WO 2017112596 | A1 * | 6/2017 | B01L 3/5082 |

OTHER PUBLICATIONS

Espacenet, English Machine Translation of Abstract for DE102011050836A1, retrieved from http://worldwide.espacenet.com, published on Dec. 6, 2012 (1 page).

* cited by examiner

CENTRIFUGE CONTAINER WITH REDUCED FLOW RESISTANCE AND SET COMPRISING A CENTRIFUGE CONTAINER AND A CENTRIFUGE ROTOR

CROSS-REFERENCE TO RELATED APPLICATIONS

The present application claims priority under 35 U.S.C. § 119 of German Patent Application No. 20 2015 006 013.7, filed Apr. 23, 2015 and German Patent Application No. 10 2015 011 876.5, filed Sep. 10, 2015, the disclosures of which are hereby incorporated herein by reference in their entireties.

FIELD OF THE INVENTION

The present invention relates to a centrifuge container for a centrifuge rotor having a base body comprising an opening, a vessel bottom and a longitudinal axis, the opening and the vessel bottom being disposed opposite each other and the base body extending with its overall length between the opening and the vessel bottom, and the centrifuge container comprising a first section extending from the opening and a second section extending to the vessel bottom along the overall length of the base body. The present invention also relates to a set comprising at least one such centrifuge container and a centrifuge rotor.

BACKGROUND OF THE INVENTION

The centrifuge container and the set according to the present invention are configured for use in a centrifuge, particularly a laboratory centrifuge. Laboratory centrifuges are used for various applications in the biochemical, chemical, biological and medical fields, such as, for example, the separation of mixtures. To that end, a sample vessel containing the mixture to be separated is placed in a centrifuge container. In some cases, the sample vessel is accommodated in an adapter in advance. The centrifuge container is fixed to a rotor, which is in turn mounted on a drive head of a drive shaft of a centrifuge drive. The rotor of the centrifuge is rotated about a rotation axis by means of the drive, during which process the centrifugal forces acting on the samples cause the separation of the mixture. Laboratory centrifuges are different from industrially used centrifuges, for example, in that they often times operate with small sample volumes, and the samples may be very sensitive and valuable, requiring very precise devices which separate the samples most accurately without having a negative impact on the sample quality.

The present invention primarily relates to laboratory centrifuges separating sample volumes up to 50 ml maximum, for example, up to 15 ml, at a capacity of up to 16 samples, in most cases up to 8 samples, at a time per run, and a centrifugal acceleration of 6,000 g maximum, for example, up to 4,000 times the gravitational acceleration (g).

Laboratory centrifuges of the above type may be operated either with centrifuge containers supported in a suspended manner together with the sample vessels in the rotor such that they swing out into a horizontal position (so-called "swinging containers") during the centrifuge run due to the centrifugal force, and with centrifuge containers arranged in the rotor at a fixed angle relative to the rotation axis, where said angle will not change during the centrifuge run (so-called "fixed angle containers"). Both types of centrifuge containers can, for example, be used in a hybrid rotor according to Patent Application No. DE 10 2015 005 195.4 of the same Applicant, to which reference is made with respect to the general structure of the centrifuge containers and of the hybrid rotor. The present invention particularly relates to centrifuge containers and sets in which the centrifuge container is only partially received in the rotor and partially protrudes outward beyond the rotor.

Due to the rotation of the centrifuge rotor, the centrifuge containers are heavily accelerated and maintained at high speed during operation of the centrifuge. In generic laboratory centrifuges, multiple problems occur during the centrifuge run due to the flow resistance of the centrifuge containers and the rotor, respectively, due to their air friction. On the one hand, the centrifuge requires a great driving power in order to overcome the flow resistance. In order to be able to provide said driving power, the centrifuge motor must be dimensioned sufficiently large, with the air friction leading to an increased energy expenditure. This results in an overall increase of the production and operation costs for the centrifuge motor. Furthermore, the centrifuge containers may heat up due to the air friction during the centrifuge run, which leads to a potential damage to the samples and therefore has to be prevented by elaborate cooling measures. Moreover, there is an increased generation of noise during the run of the laboratory centrifuge, which is perceived as disturbing by the operators. Moreover, the shape of the centrifuge containers is not freely selectable in order to decrease the flow resistance during the centrifuge run, since simple operation and an advantageous exploitation of the space available in the laboratory centrifuge are to be taken into account. For example, the centrifuge containers are supposed to be mountable on and removable from the centrifuge rotor in a most simple manner, while bulky shapes of the centrifuge containers limit the maximum number of containers that can be centrifuged per centrifuge run.

SUMMARY OF THE INVENTION

It is therefore the object of the present invention to propose centrifuge containers or a set comprising a centrifuge rotor and at least one centrifuge container, which does not cause the above-described disadvantages and which allows for the operation of a laboratory centrifuge with low generation of noise and low drive power. Furthermore, a simple operation is to be ensured and the number of centrifuge containers that can be centrifuged per centrifuge run is to be maintained as much as possible when compared to conventional centrifuge containers.

Specifically, for a centrifuge container as described above, the object is achieved in that the centrifuge container comprises a non-detachable means for reducing the flow resistance, said means being provided exclusively in the region of the second section. Thus, the means according to the present invention is exclusively located in the region of the free end of the centrifuge container and not in the region of the opening, where the centrifuge container is conventionally hooked with the centrifuge rotor. The second section of the centrifuge container reaches the highest velocities during the centrifuge run and causes a large part of the air friction. Accordingly, means for reducing the flow resistance are particularly effective in the second section. In the first section, in the region of which the centrifuge container is hooked with or mounted on the centrifuge rotor, in turn, construction space can be saved in that no means for reducing the flow resistance is provided here. By providing the means for reducing the flow resistance, the flow resistance in the second section of the centrifuge container is reduced relative to the state in which the means would not be present. At the same time, the flow resistance in the second section, in which the means is provided, is lower than in the first section located above the second section when viewed in the direction of the longitudinal extension of the centrifuge container.

The use of the means according to the present invention allows reducing the air friction by up to 20% during the centrifuge run, which enables significant savings in rotational energy and thus leads to a more cost-efficient operation and allows using motors with lower performance, which decreases production costs of the laboratory centrifuge. Reduced friction also results in a lower risk of excessive heating of the centrifuged samples, which in turn allows for a reduction of the cooling power.

Due to the fact that the means is non-detachably connected to the centrifuge container, it is ensured that the means cannot get lost or accidentally disengage. Thus, the means is not fixed to the centrifuge container after the latter has been inserted in the rotor but instead remains permanently on the centrifuge container. Nevertheless, the present invention allows saving space on the centrifuge rotor as the centrifuge containers are mounted on the centrifuge rotor in the region of their first sections, where there is no inventive means. As a result, a maximum number of centrifuge containers can be centrifuged simultaneously in one centrifuge run.

The means for reducing the flow resistance is expediently formed on the side of the centrifuge container which is in the direction of rotation of the centrifuge container when the centrifuge container is arranged in the centrifuge rotor. The direction of rotation in this case thus refers to the direction in which the centrifuge container is moved during the run of the laboratory centrifuge. In other words, in any point of the centrifuge container, the direction of rotation runs perpendicularly to a plane which contains said point and which also includes the rotation axis of the centrifuge rotor. It is assumed here that the centrifuge container is divided in two regions by a plane comprising its longitudinal axis and the rotation axis of the centrifuge rotor, the surface of the region located on the front side in the direction of rotation being the side on which the means for reducing the flow resistance is expediently provided. If the flow resistance on this side oriented forwardly in the flow direction is determined, said flow resistance, as described, is altogether lower than if the means for reducing the flow resistance would not be provided, and also lower in the region of the second section than in the region of the first section located above said second section. The methods known from the prior art can be used for measuring the flow resistance. Just as well, indirect determination is possible by means of the rotational energy that is to be spent for driving a rotor equipped with the centrifuge containers. No absolute values are required here, but merely relative values, which compare values for centrifuge containers with and without means for reducing the flow resistance, respectively, for the first and the second section. In many cases, the relative values can readily be calculated or estimated with sufficient accuracy by use of the cross-sectional shapes of the centrifuge container in its two sections.

Basically, the means may have any configuration leading to an overall more aerodynamic, more streamlined or faired shape of the centrifuge container in the second section. In a preferred variant of the present invention, the means for reducing the flow resistance consists in a change of the cross-section of the centrifuge container. In order to configure the second section of the centrifuge container in a more aerodynamic fashion than the first section, it is preferred that the cross-sectional surface oriented perpendicular to the longitudinal axis narrows to a greater extent in the direction of rotation in the second section than in the first section. In other words, the width of the centrifuge container is reduced towards the front when viewed in the direction of rotation such that the airflow is easier divided and guided past the centrifuge container on this side of the centrifuge container. When referring to a cross-sectional surface or a cross-section of the centrifuge container, this always relates to a plane oriented perpendicular to the longitudinal axis of the centrifuge container.

An especially efficient reduction of the flow residence can be achieved, for example, in that the cross-sectional surface in the region of the means according to the present invention has a semi-oval or wedge-shaped contour. The region of the centrifuge container located towards the front in the direction of rotation can be either ending into a tip or be rounded-off. Due to the respective shape of the means, the airflow is deflected laterally on the centrifuge container during the centrifuge run, so that the flow resistance decreases.

Generally, the means can be configured such that the overall shape of the centrifuge container basically changes in the second section, including the shape of the inner space. Accordingly, the means for reducing the flow resistance consists, for example, in an aerodynamic protuberance of the wall of the centrifuge container in the region of the second section. However, as a change of the shape of the inner space may cause problems when taking out the samples, it is advantageous if the contour of the inner surface of the centrifuge container in cross-section essentially remains constant over the length of the centrifuge container. For this reason, the means according to the present invention is formed such that it merely impacts the outer shape of the centrifuge container, but not the shape of the inner space. Therefore, the means is preferably arranged on the outer surface of the second section of the centrifuge container and protrudes outwards beyond the base body, for example, in the form of a fin tapering in the outward direction. In this case, a fin is a wedge-shaped structure tapering to a tipped or stump end in the direction of rotation of the centrifuge container and extending at least over a part of the second section, in the simplest case in parallel to the longitudinal axis of the centrifuge container. This shape of the means according to the present invention can be produced in a particularly simple and cost-efficient manner.

In order to effect a reduction of the flow resistance, it is sufficient if the means according to the present invention is arranged on at least one location in the second section of the centrifuge container. Flow resistance is reduced along with an increasing length of the means for reducing the flow resistance along the height of the second section. It is therefore preferred that the means is configured to extend continuously from the first section over the entire second section to the vessel bottom. In the ideal case, the means is located on the centrifuge container where said centrifuge container protrudes beyond the centrifuge rotor during the centrifuge run. This way, the best possible reduction of the flow resistance can be achieved. It is therefore further preferred that the second section is the section of the centrifuge container which protrudes beyond the centrifuge rotor during the centrifuge run and thus accounts for an essential part of the entire air friction of the entirety of centrifuge container and centrifuge rotor.

In order to keep the flow resistance as little as possible, another embodiment of the present invention provides that the second section accounts for at least 10%, preferably at least 15%, and particularly preferred between 15 and 50% and, in particular, between 15 and 30% of the total length of the base body. It is particularly efficient if the means is arranged in the region of the vessel bottom of the centrifuge container, as it reaches the highest velocity during the centrifuge run. A further reduction of the flow resistance can be achieved by elongation of the means in the direction of the opening of the centrifuge container. A maximum is reached when the means according to the present invention covers the entire region of the centrifuge container that projects beyond the rotor during the centrifuge run, or that is not shielded against the flowing air by the rotor.

The flow resistance of the centrifuge container can already considerably be reduced by attaching the means according to the present invention to the centrifuge container in the direction of rotation. The flow resistance usually decreases even more if means for reducing the flow resistance are arranged opposite each another on the centrifuge container, i.e., both in and against the direction of rotation. This counteracts the generation of turbulence during the centrifuge run and thus reduces the generation of heat and noise. Additionally, due to the symmetry, the centrifuge containers according to the present invention can be mounted in two different orientations in the centrifuge rotor, both orientations having the same effect, so that a selection of a specific orientation is not required. Thus, the operation of a laboratory centrifuge having the centrifuge containers according to the present invention is simplified.

The centrifuge containers are partially subject to extreme forces during a centrifuge run. In order to prevent an unintended detachment or disengagement of the means for reducing the flow resistance, it is preferred that the means is formed integrally with the centrifuge container. The centrifuge container comprising the means is preferably formed as injection-molded part. The production by means of an injection molding method is comparatively cost-efficient, especially when producing high quantities. Suitable materials are plastics, especially of the type that is basically already used for centrifuge containers. Containers made of plastic material provide the advantage of being particularly light. Fiber-reinforced plastics, which further increase safety against rupture of the centrifuge containers, are especially preferred. Inter alia, polyolefins, in particular polypropylene, count among suitable plastic materials. Glass or carbon fibers are suitable for fiber reinforcement, for example. The same materials and the injection molding method are also suitable for the production of the centrifuge rotor, which will be described in greater detail below. The energy consumption of the laboratory centrifuge can be reduced further by the savings in weight.

The object of the present invention is also achieved by a set comprising at least one of the above-described centrifuge containers and a centrifuge rotor with through openings completely penetrating the centrifuge rotor for receiving the at least one centrifuge container. Bearings for the at least one centrifuge container are arranged in the region of the through openings. The at least one centrifuge container at least partially, preferably completely projects with its second section from the centrifuge rotor when the centrifuge container is mounted in the centrifuge rotor. The centrifuge rotor according to the present invention corresponds to the one described in German Patent Application No. DE 10 2015 005 195.4 of the applicant. The content of said application is incorporated herein by reference. The centrifuge rotor does not completely enclose the centrifuge containers mounted in it but only comprises bearings for the centrifuge containers by means of which the latter may be hooked or mounted. The centrifuge containers are inserted in through openings of the centrifuge rotor which completely penetrate the latter, and protrude with their free ends or their vessel bottom, respectively, beyond the rotor on the side (driving side) opposite the receptacle side. This is true for both swinging containers in swinging container applications and fixed angle containers in fixed angle container applications of the centrifuge rotor. It is only due to the fact that the centrifuge containers are not completely received in the rotor that they get into contact with the airflow around the centrifuge container during the centrifuge run and thus create a need for the means according to the present invention. When using a centrifuge container according to the present invention as a set in a corresponding centrifuge rotor, the advantages of the present invention become particularly apparent.

Due to the means for reducing the flow resistance on the centrifuge containers, these containers, particularly in the second section, are configured wider compared to conventional centrifuge containers. In order to mount the centrifuge containers on the centrifuge rotor, said means are to be guided through the through openings of the centrifuge rotor before they can be mounted on the centrifuge rotor in the region of the opening of the centrifuge containers. Accordingly, the through openings have to be large enough in order that the centrifuge containers can be guided through them. If it was intended to guide the centrifuge containers through the through openings in the orientation assumed by them during the centrifuge run, the through openings would have to comprise their greatest extension in circumferential direction, or in the rotational direction of the centrifuge rotor, respectively. However, such dimensioning of the through openings has the consequence that only comparatively few through openings can be distributed over the circumference of the centrifuge rotors. A too great number of such through openings would result in very little rotor material remaining between them, which would reduce the stability of the centrifuge rotor. As a result, in order to ensure safe operation, only a small number of centrifuge containers could be mounted on the centrifuge rotor per centrifuge run, which would reduce the capacity of the laboratory centrifuge.

According to the present invention, this problem is avoided in that the through openings of the centrifuge rotor have their greatest extension in the radial direction when viewed from the rotation axis of the centrifuge rotor. Specifically, the size of the through openings in the radial direction advantageously at least corresponds to the greatest extension in the second section of the centrifuge container transverse to its longitudinal axis. Accordingly, the centrifuge containers can be inserted into and guided through the through openings with their vessel bottom end if they are rotated with their greatest width extension in the second section comprising the means for reducing the flow resistance in the radial direction when viewed from the rotational axis of the centrifuge rotor. The exact shape of the through openings is only of secondary importance here, it may be rectangular or oval, for example. What is important for the space-saving arrangement on the centrifuge rotor is that the greatest extension of the through openings is not oriented in the circumferential direction or the direction of rotation of the centrifuge rotor but in the radial direction when viewed from the rotation axis of the centrifuge rotor. In this way, it is possible to provide a greater number of through openings next to one another on the centrifuge rotor without said rotor losing stability. As a result, more centrifuge containers can be used per centrifuge run, which increases efficiency.

Hence, the centrifuge containers are not guided through the through openings in the orientation in which they are positioned during the centrifuge run. This means that after insertion into the through openings the centrifuge containers need to be brought to the orientation in which they are positioned during the centrifuge run. It is therefore preferred that the bearings in the region of the through openings of the centrifuge rotor and the centrifuge containers are configured such that the centrifuge container inserted in the through opening can be mounted on the centrifuge container after a rotation by 90° about its longitudinal axis. In other words, the centrifuge container is first of all orientated such that the means according to the present invention points towards or away from the rotation axis of the rotor. In this position, the centrifuge container is inserted into the through opening of the centrifuge rotor until its vessel bottom and the means project from the rotor on the opposite side thereof. The centrifuge container is then rotated by 90° such that the means is orientated in the direction of rotation of the centrifuge rotor. In this orientation, the centrifuge container can be hooked with or mounted on a bearing of the centrifuge rotor.

To avoid interference between the means of neighboring centrifuge containers when mounted on the centrifuge rotor, the centrifuge containers are not orientated with their longitudinal axis in parallel to the rotation axis of the centrifuge rotor during the centrifuge run but at an angle to said rotation axis. This applies to both fixed angle and also swinging container applications. By arranging the centrifuge containers in said manner relative to the rotation axis of the centrifuge rotors, the free ends of the centrifuge containers are radially spaced from one another, so that the means have sufficient space and a contact between the centrifuge containers is prevented. Even more space can be achieved if neighboring centrifuge containers are supported in the rotor in a staggered manner, and preferably such that the inclination angles differ from one another. The free ends of the centrifuge containers and the means are then located at different heights relative to the rotation axis of the centrifuge rotor.

The present invention is described in greater detail below by means of the exemplary embodiments shown in the figures. However, the present invention is not limited to these exemplary embodiments.

BRIEF DESCRIPTION OF THE DRAWINGS

In the schematic figures.

Throughout the figures, like components are designated by like reference numerals. Repeating components are not designated separately in each figure.

DETAILED DESCRIPTION OF THE INVENTION

Figure 1:
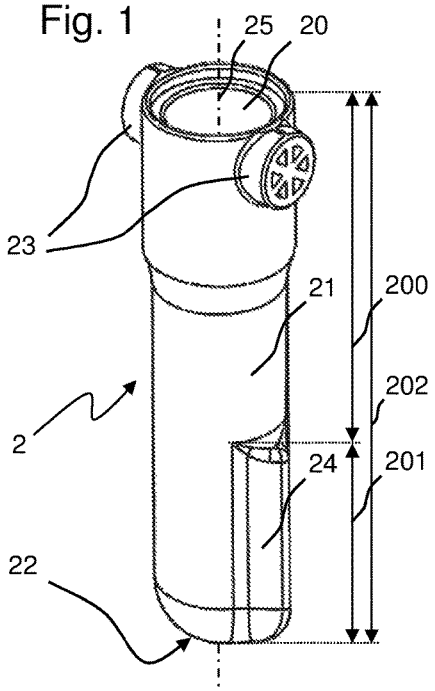
FIG. 1 shows a centrifuge container configured as a swinging container.
Figure 2:
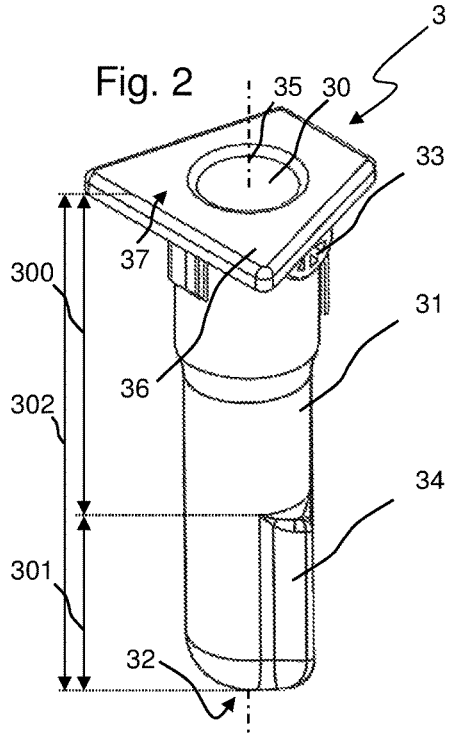
FIG. 2 shows a centrifuge container configured as fixed angle container.

FIGS. 1 and 2 each show a centrifuge container 2, 3. The centrifuge containers 2, 3 respectively comprise a base body 21, 31 with an opening 20, 30 for receiving a sample vessel and a vessel bottom 22, 32. The centrifuge container 2, 3 extends with its overall length 202, 302 from the opening 20, 30 to the vessel bottom 22, 32. The overall length 202, 302 is divided into a first section 200, 300 located on the side of the opening 20, 30 and a second section 201, 301 extending from the first section 200, 300 to the vessel bottom 22, 32. In the present case, the second section 201, 301 accounts for about a third of the overall length 202, 302 of the centrifuge containers 2, 3. The overall length 202, 302 of the centrifuge containers 2, 3 extends parallel to the respective longitudinal axis 25, 35 of the centrifuge containers 2, 3.

Figure 3:
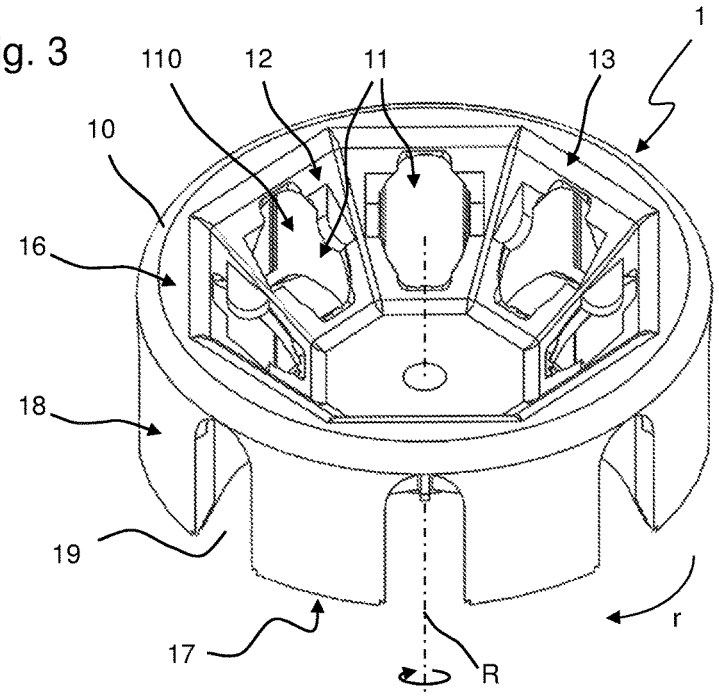
FIG. 3 shows a centrifuge rotor.

An associated centrifuge rotor 1 is illustrated in FIG. 3. The centrifuge rotor 1 and at least one centrifuge container 2, 3 constitute a set according to the present invention. The centrifuge rotor 1 comprises a rotor base body 10 and is configured for rotation about the rotation axis R in the direction of rotation r. The rotor base body 10 comprises a receptacle side 16, a drive side 17 and a lateral surface 18. The centrifuge rotor 1 is placed on a drive head of a centrifuge motor (not illustrated) during operation of a laboratory centrifuge. The rotor base body 10 comprises through openings 11 on the receptacle side 16 for receiving the centrifuge containers 2, 3. The through openings 11 completely penetrate through the rotor base body 10 and form openings 19 in the lateral surface 18 and on the drive side 17 of the rotor base body 10. During the centrifuge run, the centrifuge containers 2, 3 protrude from the openings 19, as will be described below. Further details of the centrifuge rotor are described in German Patent Application No. DE 10 2015 005 195.4, to which reference is again made hereby.

Figure 4:
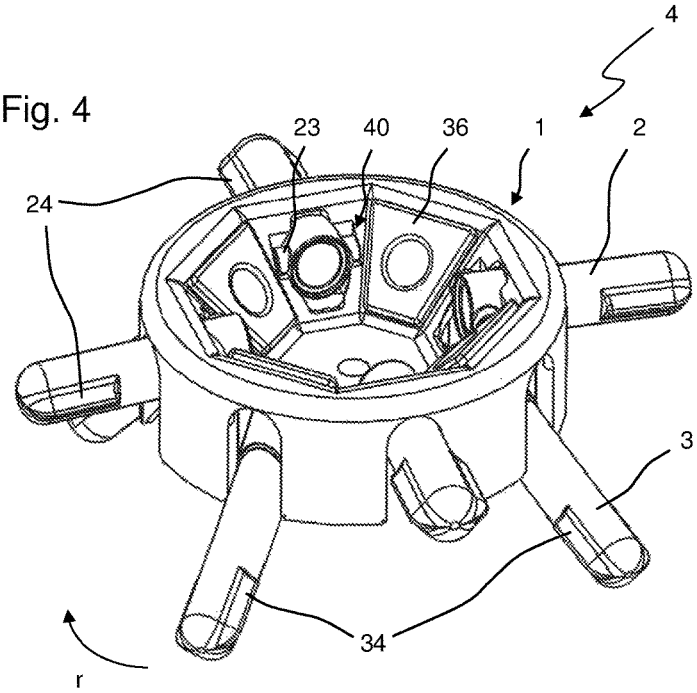
FIG. 4 shows a centrifuge rotor in mixed operation.
Figure 5:
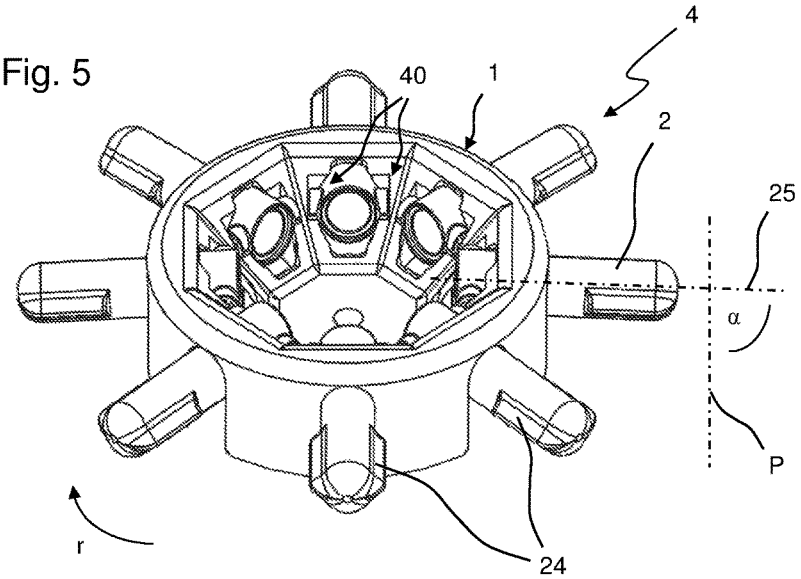
FIG. 5 shows a centrifuge rotor in operation with swinging containers.

The centrifuge containers 2, 3 are inserted into insertion openings 110 of the through openings 11 from the receptacle side and are then mounted on the centrifuge rotor 1. To that end, bearings in the form of rotary bearings 12 and fixed bearings 13 are provided on the centrifuge rotor 1 or on the rotor base body 10, respectively. Centrifuge container 2 of FIG. 1 is configured as a swinging container. It comprises trunnions 23 by means of which it can be mounted in the rotary bearing 12 of the base body 10. In a set 4, comprising a centrifuge rotor 1 and at least one centrifuge container 2, 3 as illustrated in FIGS. 4 and 5, the rotary bearing 12 and the trunnions 23 together form a rotary joint 40 enabling the centrifuge container 2 to swing out into a swung-out position during the centrifuge run. In the swung-out position, the longitudinal axis 25 of centrifuge container 2 is oriented at an angle $\alpha$ relative to a parallel P to the rotation axis R of centrifuge rotor 1. Here, the swing angle $\alpha$ is nearly 90°, for example, between 85 and 89°.

According to FIG. 2, centrifuge container 3 is configured as a fixed angle container. It comprises trunnions 33 configured to fill the rotary bearing 12 of the centrifuge rotor 1. Furthermore, the centrifuge container 3 comprises a collar 36 which is configured complementary to the fixed bearing 13 and may rest against said bearing. The collar 36 prevents the centrifuge container 3 from swinging during a centrifuge run and defines a fixed angle $\beta$, which is enclosed by the longitudinal axis 35 of the centrifuge container 3 and a parallel P to the rotation axis R of the centrifuge rotor 1. Said fixed angle β is not changed during the centrifuge run, but remains constant. The angle β is preferably 60° maximum and particularly between 25 and 50°. As an alternative, the collar 36 of the centrifuge container 3 may also be configured as a detachable adapter 37, by means of which a swinging type centrifuge container 2 can be converted to a centrifuge container 3 of the fixed angle type.

The means 24, 34 according to the present invention for reducing the flow resistance are arranged in the second section 201, 301 of the centrifuge containers 2, 3. In the exemplary embodiments shown in FIGS. 1 and 2, the means 24, 34 are configured to extend over the entire second section 201, 301 to the vessel bottom 22, 32 and have a fin shape. They are protrusions on the centrifuge containers 2, 3, tapering in the radial direction away from the longitudinal axis 25, 35 of centrifuge containers 2, 3. As result, the means 24, 34 form a wedge at the lateral surfaces of which the airflow is divided and guided past the centrifuge containers 2, 3. By this division of the airflow, the flow resistance or the air friction of centrifuge containers 2, 3 is significantly reduced during the centrifuge run. The fins are formed in a solid manner and integrally with the centrifuge containers 2, 3. Preferably, the manufacturing of the centrifuge container equipped with the fins is effected by means of injection molding, for example, from fiber-reinforced polypropylene. The centrifuge containers 2, 3 comprise a conventional cylindrical inner space, in which conventional sample vessels can be supported.

Figure 6:
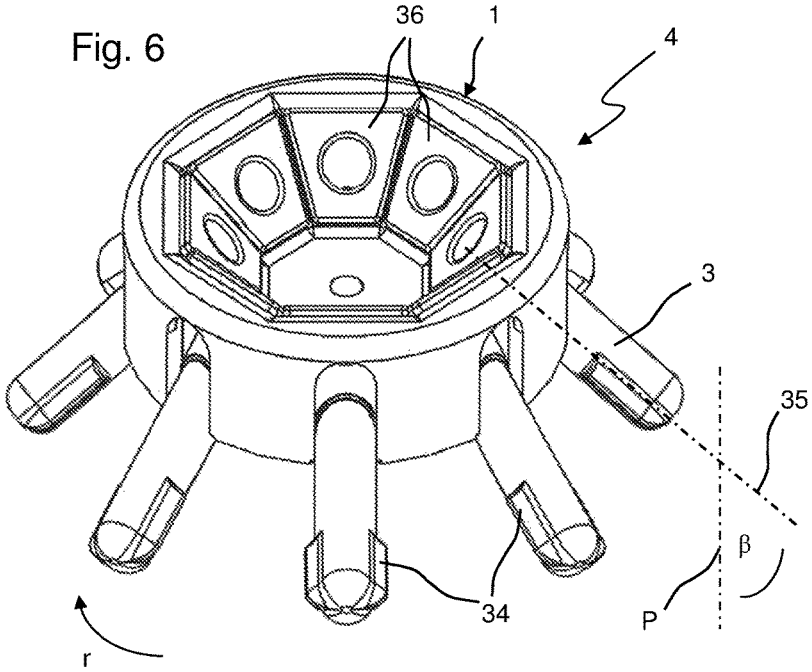
FIG. 6 shows a centrifuge rotor in operation with fixed angle containers.

As can be taken from FIGS. 4, 5 and 6, in each case two opposite means 24, 34 are formed on the centrifuge containers 2, 3 in and against the direction of rotation r. In contrast to the first section 200, 300, said means 24, 34 protrude laterally beyond the base body of the centrifuge container 2, 3 such that said container—except for the mounting devices 23, 33, 36 in the opening-sided region—has its greatest extension transversely to the longitudinal axis 25, 35 in the second section. However, in contrast to means 24, 34, the mounting devices do not need to be guided through the openings 11 in the rotor. If the through openings 11 in the rotor were enlarged in the circumferential direction such that it would be possible to insert the centrifuge containers 2, 3 through the openings with the means 24, 34 orientated in the direction of rotation r, the width of openings 11 would have to be increased in the circumferential direction on the one hand, and, on the other hand, the mounting devices 23, 33, 36 would have to be widened laterally. This would result in that less through openings 11 and therefore less centrifuge containers would fit in the rotor and/or in that the rotor would lose stability in the case that the openings 11 were arranged too close next to one another, which in turn would increase the risk of rupture. According to the present invention, said problem is solved in that the greatest extension of the through openings 11 of the centrifuge rotor 1, i.e., the extension required for passing through the means 24, 34, is oriented in the radial direction when viewed from the rotation axis R of the centrifuge rotor 1. This allows for the width of through openings 11 in the circumferential direction of the rotor to remain identical to the width that would be required for centrifuge containers which do not comprise the means 24, 34. As a result, neither capacity nor safety are impaired on the rotor per se, nor is there a need to enlarge the mounting devices of the centrifuge containers, which would be disadvantageous with respect to operation and costs of the same.

Figure 7:
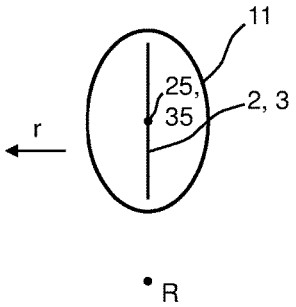
FIG. 7 shows a very simplified top view of an insertion opening of the centrifuge rotor with a centrifuge container guided therethrough but not yet mounted on the centrifuge rotor.
Figure 8:
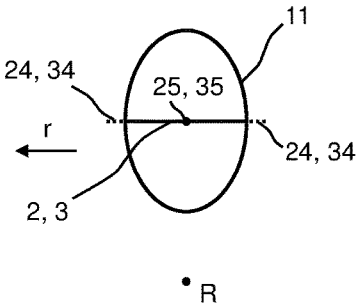
FIG. 8 shows a very simplified top view of an insertion opening of a centrifuge rotor and a centrifuge container mounted on the centrifuge rotor.

For the centrifuge containers 2, 3 having the means 24, 34, this means that they are guided through the through openings 11 in a different orientation than the one they will be positioned in during the centrifuge run. Specifically, after guiding through the second section equipped with fins, the centrifuge containers 2, 3 have to be rotated before they can be mounted on the rotor. This process is schematically illustrated in FIGS. 7 and 8. FIG. 7 is a top view of an insert opening 110 in which the vessel bottom sided end of a centrifuge container 2, 3 is being inserted. The centrifuge container is merely represented by a line representing the width of its free end facing away from the mounting devices 23, 33, 36. Accordingly, the length of the line corresponds to the width in the region of the second section of the centrifuge container comprising the fins 24, 34. The point 25, 35 represents the longitudinal axis of the centrifuge container. In order to be able to introduce the centrifuge container into the insert opening 110, it is initially rotated such that its greatest width extension on its vessel bottom sided end is oriented in the radial direction when viewed from the rotation axis R of the centrifuge rotor 1. In this orientation, the centrifuge container 2, 3 is inserted into the through opening 11 until the second section 201, 301 of the centrifuge container 2, 3 completely projects beyond the rotor base body 10 of the centrifuge rotor 1 on the drive side 17. Then, the centrifuge container 2, 3 is rotated by 90° about its longitudinal axis 25, 35, as illustrated in FIG. 8. As a result, the means 24, 34 are orientated in the direction of rotation r. In this orientation, the means 24, 34 protrude laterally beyond the circumference of the insertion opening 11, which is indicated by the dotted lines in FIG. 8. In said position, the trunnions 23 are also aligned with the rotary bearing 12 or the trunnions 33 and the collar 36 are aligned with the fixed bearing 13 of the centrifuge rotor 1, so that the centrifuge container can be mounted on the rotor. The removal of a centrifuge container 2, 3 after a centrifuge run is effected in the same way as the mounting process, however in reverse order.

The present invention unites a reduction in flow resistance of the centrifuge containers 2, 3 and a space-saving configuration of the centrifuge rotor 1 in an advantageous manner without reducing the operating safety or capacity, increasing production and operating costs or impairing the handling.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A centrifuge container for a centrifuge rotor, comprising:

a base body having an opening and a vessel bottom, the opening and the vessel bottom being situated opposite each other and the base body having an overall length extending between the opening and the vessel bottom, the centrifuge container comprising, along the overall length of the base body, a first section extending from the opening and a second section extending to the vessel bottom, wherein the centrifuge container comprises, non-detachably connected thereto, means for the reduction of flow resistance, the means being provided exclusively in the region of the second section on a side of the centrifuge container that is in a direction of rotation of the centrifuge container when the centrifuge container is arranged in the centrifuge rotor.

2. The centrifuge container according to claim 1, wherein the means is a changing cross-sectional area of the centrifuge container, such that the cross-sectional area of the centrifuge container perpendicular to a longitudinal axis narrows to a greater extent in the second section than in the first section in the direction of rotation (r) of the centrifuge rotor (1).

3. The centrifuge container according to claim 1, wherein the means has a semi-oval or wedge-shaped cross-section in a direction perpendicular to a longitudinal axis of the centrifuge container.

4. The centrifuge container according to claim 1, wherein the means is configured as a fin radially protruding away from the longitudinal axis of the base body and tapering in the outward direction.

5. The centrifuge container according to claim 1, wherein the means is configured so as to extend continuously over the entire second section to the vessel bottom.

6. The centrifuge container according to claim 1, wherein the second section comprises at least 10% of the overall length of the base body.

7. The centrifuge container according to claim 1, wherein the means are provided opposite each other on the centrifuge container.

8. The centrifuge container according to claim 1, wherein the means is formed integrally with the centrifuge container.

9. A set comprising at least one centrifuge container according to claim 1 and a centrifuge rotor with through openings completely penetrating said rotor for accommodating the at least one centrifuge container, bearings being arranged for the at least one centrifuge container in the region of the through openings, and the at least one centrifuge container at least partially protruding with its second section from the centrifuge rotor when the centrifuge container is mounted in the centrifuge rotor.

10. The set according to claim 9, wherein the size of the through openings in the radial direction relative to the rotation axis (R) of the centrifuge rotor corresponds at least to the greatest extension of the second section of the centrifuge container transversely to its longitudinal axis, so that the second section of the centrifuge container can be guided through the through openings.

11. The set according to claim 10, wherein the bearings in the region of the through openings of the centrifuge rotor and the at least one centrifuge container are configured such that the centrifuge container inserted into the through opening can be mounted in one of the bearings of the centrifuge rotor after rotation by 90° about its longitudinal axis.

12. The centrifuge container according to claim 1, wherein the second section comprises at least 15% of the overall length of the base body.

13. The centrifuge container according to claim 1, wherein the second section comprises at least between 15% and 30% of the overall length of the base body.

14. The centrifuge container according to claim 1, wherein the second section comprises at least between 15% and 50% of the overall length of the base body.

15. The centrifuge container according to claim 1, wherein the centrifuge container comprises an injection-molded part.

* * * * *